US008177156B1

(12) United States Patent
Rinne

(10) Patent No.: US 8,177,156 B1
(45) Date of Patent: May 15, 2012

(54) SHEET ROLL DISPENSER

(76) Inventor: Rhett L. Rinne, Chester, IL (US)

( * ) Notice: Subject to any disclaimer, the term of this patent is extended or adjusted under 35 U.S.C. 154(b) by 262 days.

(21) Appl. No.: 12/623,924

(22) Filed: Nov. 23, 2009

(51) Int. Cl.
*B65H 20/02* (2006.01)

(52) U.S. Cl. ..... 242/564.4; 242/595.1; 400/613

(58) Field of Classification Search ..... 242/595, 242/595.1, 564, 564.3, 564.4; 400/613
See application file for complete search history.

(56) References Cited

U.S. PATENT DOCUMENTS

| | | | | |
|---|---|---|---|---|
| 2,824,774 | A * | 2/1958 | Embree | 242/564.4 |
| 2,957,638 | A * | 10/1960 | Schiller et al. | 242/595 |
| 3,143,947 | A * | 8/1964 | Limberger | 242/564.4 |
| 3,624,875 | A * | 12/1971 | Haft | 242/538.2 |
| 4,663,638 | A * | 5/1987 | Hirose | 400/613 |
| 4,960,248 | A | 10/1990 | Bauer et al. | |
| 5,060,877 | A | 10/1991 | Bullivant | |
| 5,791,796 | A * | 8/1998 | Gustavsson et al. | 400/613 |
| 6,069,354 | A | 5/2000 | Alfano et al. | |
| 6,179,243 | B1 | 1/2001 | Granger | |
| 6,406,200 | B2 * | 6/2002 | Mahoney | 400/690.4 |
| 6,419,136 | B2 | 7/2002 | Formon et al. | |
| 7,370,824 | B1 | 5/2008 | Osborne | |
| 2001/0043828 | A1 * | 11/2001 | Mahoney | 400/55 |
| 2002/0109035 | A1 | 8/2002 | Denen et al. | |
| 2003/0222779 | A1 | 12/2003 | Schotz et al. | |
| 2004/0047667 | A1 * | 3/2004 | Huggins et al. | 400/88 |

* cited by examiner

*Primary Examiner* — William A Rivera
(74) *Attorney, Agent, or Firm* — Ronald E. Smith; Smith & Hopen, P.A.

(57) ABSTRACT

A sheet roll dispenser includes an open-top hollow housing closed by a hingedly mounted lid. A first embodiment includes first and second roller support members mounted within the housing. A roll of sheet material is supported by the first roller support member when the housing is in a tabletop orientation and by the second roller support member when in a wall-mounted orientation. A nip is mounted in registration with an opening formed in the front wall. A free end of the sheet material is disposed in the nip. A switch actuator actuates a motor, causing the free end of the sheet material to be unrolled from the core and dispensed to a user through the opening. In a second embodiment, the roller support members may be rotatably mounted rollers, low-friction surfaces, or both. A third embodiment eliminates the rollers and plates and provides a "U"-shaped low friction surface.

5 Claims, 4 Drawing Sheets

SHEET ROLL DISPENSER

BACKGROUND OF THE INVENTION

1. Field of the Invention

This invention relates, generally, to devices that dispense rolled sheets such as paper towels, toilet tissue, and the like. More particularly, it relates to such a dispenser that includes an electrical motor.

2. Description of the Prior Art

People who lack manual dexterity may find it difficult to unroll a sheet of material from a roll such as a roll of toilet paper or a roll of paper towels. Several inventors have provided various mechanical devices for their benefit but the devices heretofore known are mechanically complex, expensive to manufacture and therefore not affordable to those on a tight budget.

There is a need, then, for a sheet roll dispenser of elegant, inexpensive, and affordable design.

Most conventional sheet roll dispensers are wall-mounted. However, space limitations may sometimes dictate that such a dispenser be mounted on a tabletop instead, or a pedestal. For example, all of the available wall space may be occupied by a conventional dispenser and it may be desired to leave the conventional dispenser alone when installing a special dispenser. In such a situation, a tabletop or pedestal-mounted dispenser is desirable.

The ideal dispenser would be one that could be wall, pedestal, or tabletop-mounted.

However, in view of the prior art considered as a whole at the time the present invention was made, it was not obvious to those of ordinary skill in the applicable field of art how the identified needs could be met.

SUMMARY OF THE INVENTION

The long-standing but heretofore unfulfilled need for an improved, more versatile sheet roll dispenser is now met by a new, useful, and non-obvious invention.

The inventive structure is a sheet roll dispenser that includes an open-top hollow housing having a front wall, a back wall, a bottom wall and a pair of side walls. A lid is hingedly connected to the housing for selectively opening and closing the open top of the hollow housing. A motor and a drive roller are mounted to the underside of the lid. The drive roller is connected in driven relation to the motor.

In a first embodiment, a first pair of idler rollers and a second pair of idler rollers are rotatably mounted within a hollow interior of the hollow housing. The first pair of idler rollers underlie and support a roll of sheet material when the apparatus is mounted on a substantially horizontal structure such as a tabletop or a pedestal. The second pair of idler rollers underlie and support the roll of sheet material when the apparatus is mounted on a substantially vertical wall. When the apparatus is horizontally-mounted, the first pair of idler rollers is generally horizontally disposed in supporting relation to the roll of sheet material and the second pair of idler rollers is vertically disposed and in non-contacting relation to the roll of sheet material. When the apparatus is vertically-mounted, the second pair of idler rollers is generally horizontally disposed in supporting relation to the roll of sheet material and the first pair of idler rollers is vertically disposed and in non-contacting relation to the roll of sheet material.

In the first embodiment, one of the idler rollers of the second pair of idler rollers forms a nip means with the drive roller. The idler roller that forms a part of the nip means is flexibly and resiliently biased against the drive roller so that sheet material unrolled from said roll of sheet material may be fed through said nip means upon activation of said motor.

In a second embodiment the first and second pairs of idler rollers are partially replaced or supplemented by first and second substantially flat or slightly arcuate plates having low-friction surfaces. At least a first, substantially horizontally disposed flat or slightly arcuate plate underlies and supports the roll of sheet material when the apparatus is mounted on a substantially horizontal structure such as a tabletop or a pedestal. At least a second, substantially vertically disposed flat or slightly arcuate plate is in non-contacting relation to the roll of sheet material when the apparatus is mounted on said substantially horizontal structure. The at least a second flat or slightly arcuate plate supports the roll of sheet material when the apparatus is mounted on a substantially vertical structure and said at least a first flat or slightly arcuate plate is in non-contacting relation to said roll of sheet material when said apparatus is in its vertically-mounted configuration.

The second embodiment is thus understood to include an apparatus having the first and second pairs of idler rollers of the first embodiment supplemented by the flat or slightly arcuate plates of the second embodiment so that rollers and low-friction plates are provided, as well as an embodiment that includes the low-friction plates but which does not include said first pair of rollers that are horizontally-disposed when the apparatus is horizontally disposed. However, the second embodiment that includes the low-friction plates without the first pair of idler rollers includes one roller of the second pair of idler rollers to form a nip means with the drive roller.

In a third embodiment, the first and second pairs of idler rollers of the first embodiment and the low-friction plates or roller and plate combinations of the second embodiment are replaced by a generally "U"-shaped low-friction support structure. The bight region of the "U"-shaped structure supports the roll of sheet material when the novel apparatus is supported by a horizontal tabletop or pedestal and a forward, substantially vertical wall of said structure supports the roll of sheet material when the novel apparatus is mounted on a vertical support structure such as a wall. This third embodiment includes no rollers of the first and second pair of rollers and no low-friction flat or slightly arcuate plates. However, it does include the drive roller. The uppermost end of the forward wall of the generally "U"-shaped structure is configured into an arcuate surface that flexibly and resiliently bears against the drive roller to form a nip means.

In all three embodiments, a user-operated switch actuator activates the motor, causing rotation of the drive roller. In the first two embodiments, the free end of the sheet material is unrolled from the core and is dispensed to a user through the nip means formed by the drive roller and an idler roller. In the third embodiment, the nip means is formed by the drive roller and the arcuate part of the generally "U"-shaped structure as aforesaid.

The switch actuator is preferably selected from a group of suitable switch actuators including a mechanical switch, a photoelectric switch, or a proximity sensor, but not excluding other suitable switch actuators.

An important object of the invention is to enable people who lack manual dexterity to be able to unroll a length of sheet material from a rotatably mounted core without needing to grasp the sheet material in order to cause the unrolling.

Another object is to provide a dispenser that can be table or pedestal mounted or wall mounted without affecting its operation.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
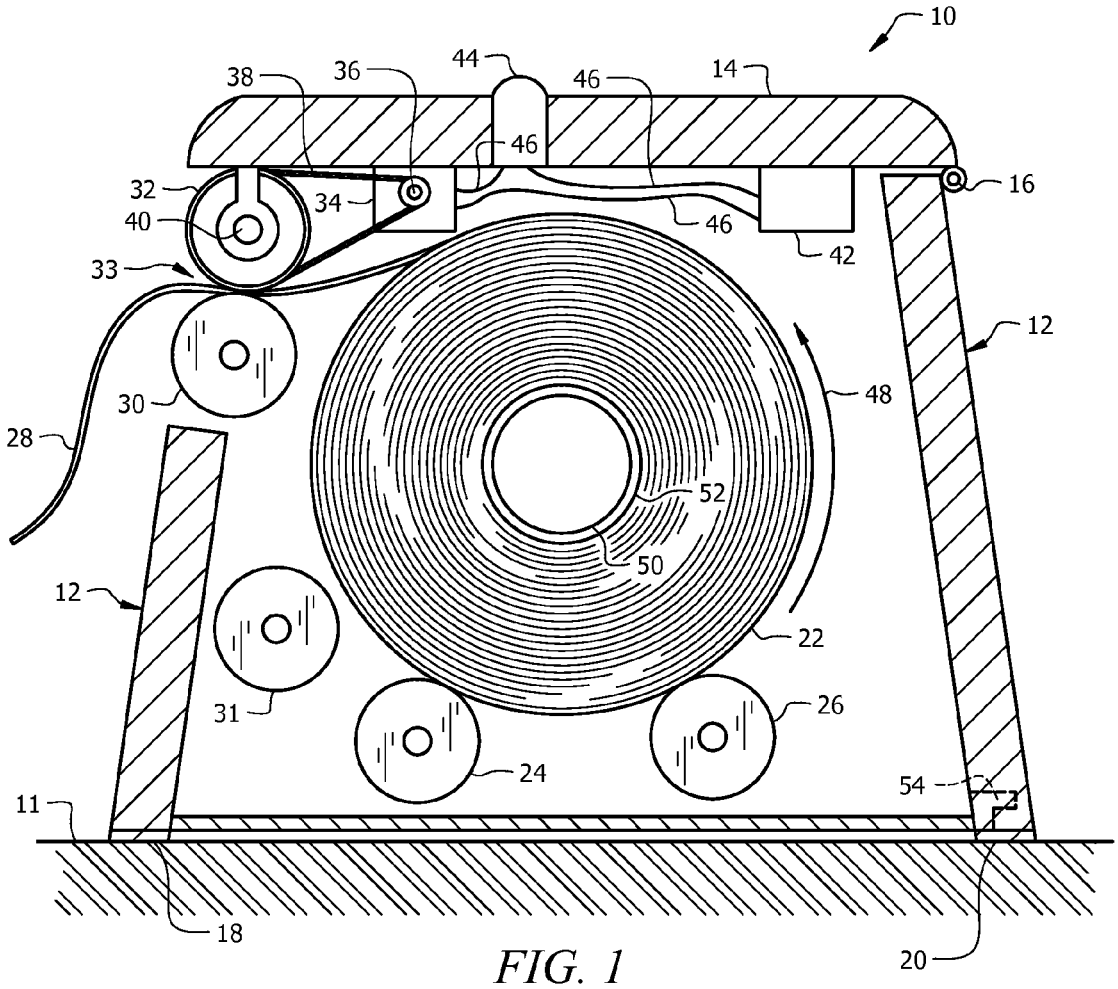
FIG. 1 is a sectional, side elevational view of a first illustrative embodiment of the novel dispenser when in its tabletop orientation.

Referring now to FIG. 1, it will there be seen that a diagrammatic representation of a first embodiment of the novel sheet roll dispenser is denoted as a whole by the reference numeral 10.

In this first embodiment, sheet roll dispenser 10 includes open-top hollow housing 12 having lid 14 connected to housing 12 by hinge 16. Housing 12 includes a front wall as depicted and an opening is formed in said front wall.

Sheet roller dispenser 10 has two different operative configurations. In FIG. 1, dispenser 10 is supported by a tabletop, pedestal, or other suitable horizontal support surface, not depicted. Pads 18, 20 protect the tabletop from marring and also provide friction to help prevent dispenser 10 from slipping relative to the support surface.

In this first embodiment, roll of sheet material 22 is supported by idler rollers 24, 26. Lid 14 is opened so that roll 22 can be positioned atop said rollers as depicted. A free end 28 of the sheet material is fed between idler roller 30 and drive roller 32 that are biased toward one another so that they flexibly and resiliently abut one another and form nip means 33. Lid 14 is then closed.

Motor 34 is mounted to an underside of lid 14 and includes power take off shaft 36. A suitable interconnecting means such as drive belt 38 interconnects power take off shaft 36 and drive roller 32. As depicted, drive belt 38 wraps around the periphery of drive roller 32 and therefore provides a frictional surface for engaging the sheet material. However, drive belt 38 could also be wrapped around axle 40 or an axle-mounted hub of drive roller 32. In that arrangement, the periphery of drive roller 32 could be coated with a layer of suitable friction-enhancing material or a plurality of low durometer bands not connected to drive belt 38 could be wrapped about the periphery of drive roller 32 to provide extra friction. A tube having a high friction surface could also be fitted tightly around said drive roller 32 for the same purpose.

Gears or other interconnecting means for connecting idler roller 32 in driven relation to motor 34 are also within the scope of this invention.

Motor 34 is in electrical communication with a source of electrical power which may be provided by batteries housed within battery compartment 42 in which embodiment motor 34 is a DC motor. Alternatively, motor 34 can be placed into electrical communication with an AC source and battery compartment 42 would in that embodiment be replaced by a junction box.

Motor 34 may be provided in the form of a step motor so that when activated it operates for a predetermined length of time and then shuts off so that a predetermined length of sheet material is dispensed. It may also be of the continuous operation type so that is shuts off only when the switch is opened, thereby enabling a user to determine the length of sheet material to be dispensed.

In all embodiments, switch actuator 44 controls the delivery of DC or AC power to motor 34. Actuator 44 may be a mechanical switch, a photoelectric switch, a proximity sensor, or any other suitable type of switch means. The electrical conductors are collectively denoted 46.

When switch actuator 44 is actuated, roll of sheet material 22 rotates in the direction indicated by directional arrow 48 about axle 50. The rotation may be in the opposite direction, depending upon the orientation of roll 22 within dispenser 10. Motor 34 is therefore a bi-directional motor. As roll 22 decreases in diameter, it loses contact with idler rollers 24, 26 but the weight of roll 22 also decreases so the support provided by said rollers 24, 26 is no longer needed.

When all of the sheet material has been dispensed, core 52 is removed by opening lid 14 and a new roll 22 is inserted into housing 12 atop idler rollers 24, 26 as before.

Figure 2:
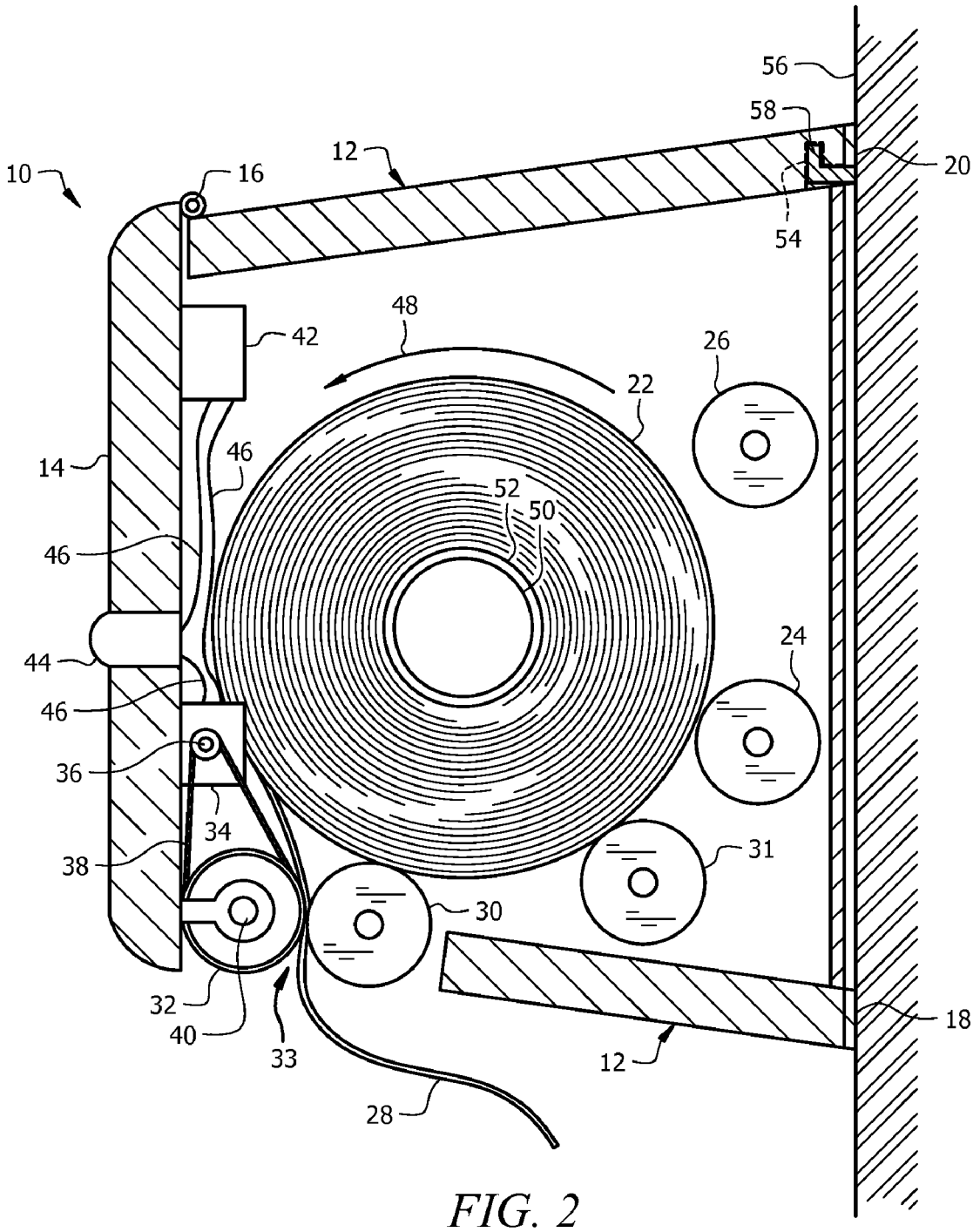
FIG. 2 is a sectional, side elevational view of said first embodiment of the novel dispenser when in its wall-mounted orientation.

A second mounting arrangement for this first embodiment is depicted in FIG. 2. Cavity 54 is formed in housing 12, as depicted in FIGS. 1 and 2, and dispenser 12 is mounted on a vertical wall 56 by a wall-mounted hook that releasably engages cavity 54. When so disposed, sheet material roll 22 rests not atop idler rollers 24 and 26 as in the horizontally disposed embodiment of FIG. 1, but upon idler rollers 30 and 31 instead.

Figure 3:
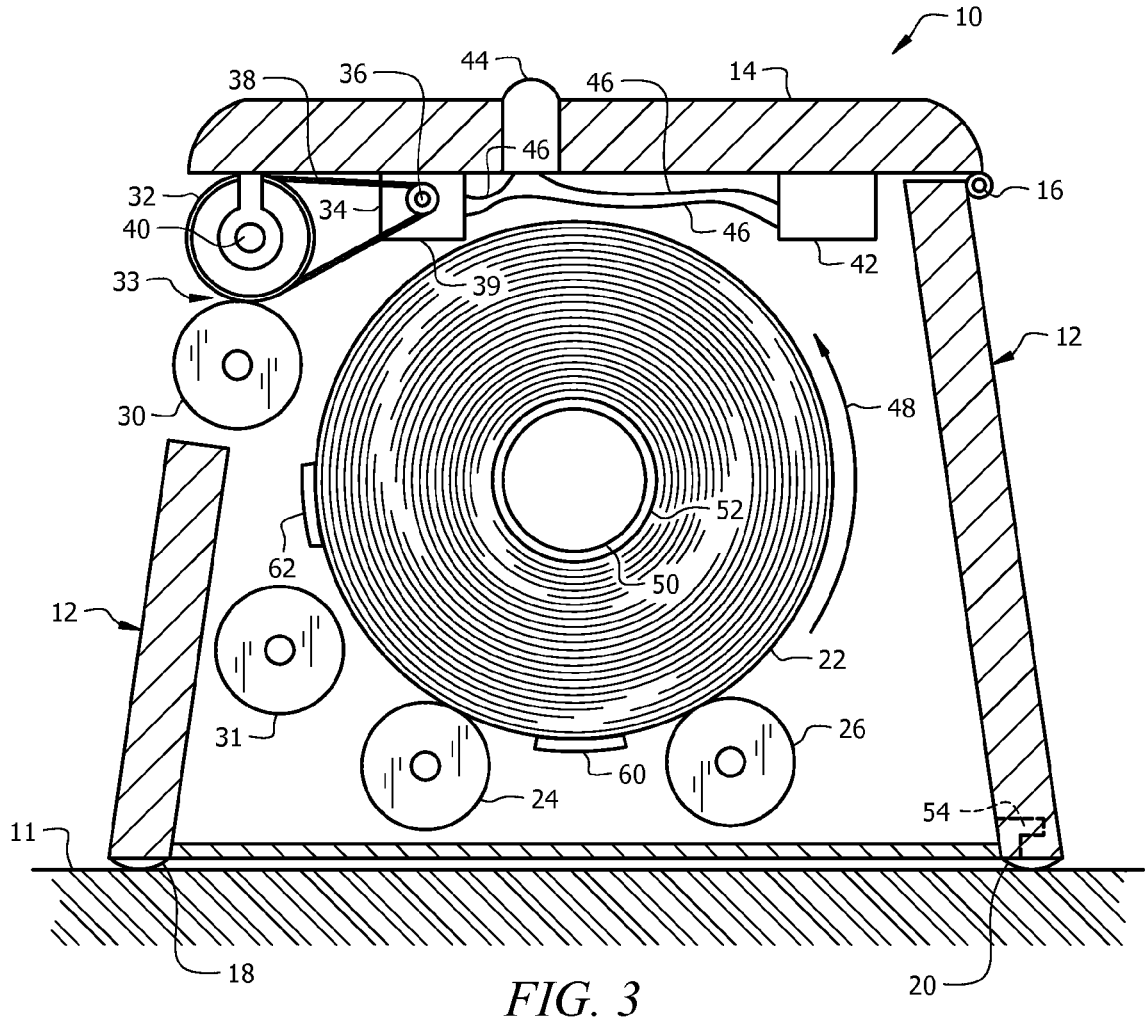
FIG. 3 is a sectional, side elevational view of a second embodiment where the first pair of rollers is replaced or supplemented by at least one low-friction plate and the second pair of rollers is partially replaced or supplemented by at least one low-friction plate.

The second embodiment is depicted in FIG. 3. At least one low-friction plate 60 supports roll 22 when apparatus 10 is table or pedestal-mounted and at least one low-friction plate 62 supports roll 22 when apparatus 10 is wall-mounted. As indicated in FIG. 3, rollers 24, 26 and 30, 31 may also be used in conjunction with low-friction plates 60, 62. Rollers 24, 26 of the first pair of rollers may be completely eliminated and roller 31 of the second pair may be eliminated as well but roller 30 is needed to form nip means 33.

Figure 4:
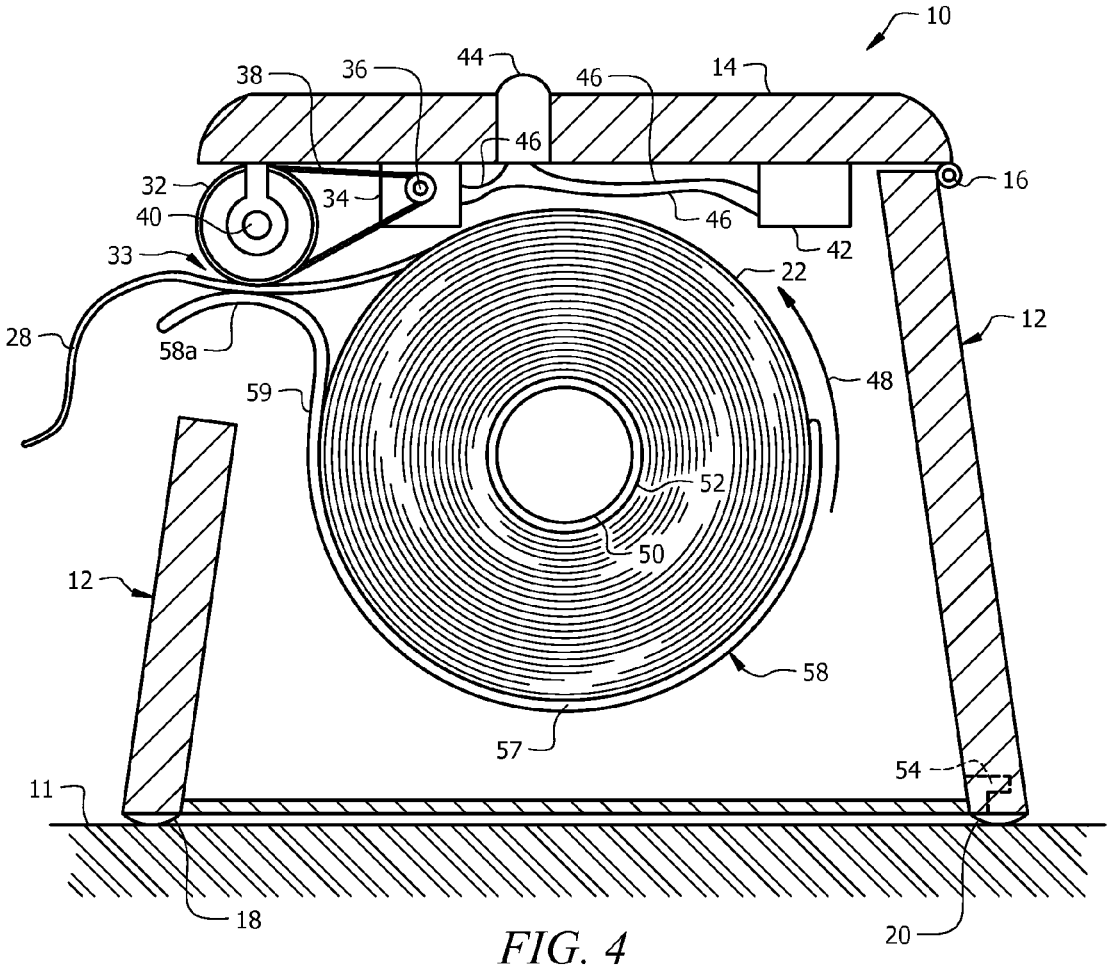
FIG. 4 is a sectional, side elevational view of a third embodiment where the first and second pairs of rollers and the low-friction flat or slightly arcuate plates are replaced by a single low-friction, generally "U"-shaped, low-friction support structure.

The third embodiment is depicted in FIG. 4. Low-friction, generally "U"-shaped structure 58 supplants first pair of rollers 24, 26 and second pair of rollers 30, 31. Low-friction structure 58 is at least slightly flexible. Bight region 57 of said low-friction structure 58 supports roll 22 when the novel apparatus is table or pedestal-mounted and substantially vertical forward wall 59 of said low-friction structure 58 supports roll 22 when the apparatus 10 is wall-mounted.

In this third embodiment, the uppermost end of forward vertical wall 59 is formed into an arcuate section denoted **58*a* and is positioned in abutting but flexible and resilient relation to drive roller 32 to form nip means 33 through which sheet material 28 passes when motor 34** is operating.

Accordingly, the first embodiment of this invention includes said first and second pairs of rollers without low-friction plates, the second embodiment includes said first and second pairs of rollers used in conjunction with low-friction plates or said low-friction plates without the first pair of rollers but with one nip-means forming roller of the second pair of rollers, and the third embodiment includes said low-friction structure 58 without said first and second pairs of rollers.

It will thus be seen that the objects set forth above, and those made apparent from the foregoing description, are efficiently attained and since certain changes may be made in the above construction without departing from the scope of the invention, it is intended that all matters contained in the foregoing description or shown in the drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A sheet roll dispenser, comprising:

said sheet roll dispenser adapted to be mounted in a first, horizontal position or a second, vertical position;

an open-top hollow housing having a front wall;

a lid hingedly connected to said hollow housing for selectively opening and closing said open top of said hollow housing;

said lid positioned in a substantially horizontal plane when said sheet roll dispenser is in said first, horizontal position and said lid positioned in a substantially vertical plane when said sheet roll dispenser is positioned in said second, vertical position;

said hollow housing adapted to house a roll of sheet material;

a roll support member mounted in said hollow housing;

said roll support member including a first pair of idler rollers disposed in a substantially horizontal plane in supporting relation to said roll of sheet material and a second pair of idler rollers disposed in a substantially vertical plane in non-supporting relation to said roll of sheet material when said housing is mounted in said first, horizontal position;

said roll support member including said first pair of idler rollers disposed in a substantially vertical plane in non-supporting relation to said roll of sheet material and said second pair of idler rollers disposed in a substantially horizontal plane in supporting relation to said roll of sheet material when said housing is disposed in said second, vertical position;

an opening formed in said front wall of said housing:

a nip means mounted in registration with said opening;

a free end of said sheet material adapted to be disposed in said nip means;

a motor mounted to an underside of said lid;

said motor including a power take off shaft;

a drive roller mounted to an underside of said lid;

said nip means including said drive roller and an idler roller of said second pair of idler rollers;

interconnecting means for interconnecting said drive roller in driven relation to said power takeoff shaft; and a switch actuator for activating said motor;

whereby activation of said motor causes said free end of said sheet material to be unrolled, to travel through said nip means, and to be dispensed to a user through said opening.

2. The sheet roller dispenser of claim 1, further comprising:

said roll support member including a horizontally disposed low-friction plate disposed in supporting relation to said roll of sheet material when said housing is disposed in said first horizontal position;

said roll support member further including a vertically disposed low-friction plate in non-supporting relation to said roll of sheet material when said housing is disposed in said first, horizontal position;

said vertically disposed low-friction plate disposed in supporting relation to said roll of sheet material when said housing is disposed in said second, vertical position and said horizontally disposed low-friction plate disposed in non-supporting relation to said roll of sheet material when said housing is disposed in said second, vertical position.

3. The sheet roll dispenser of claim 1, further comprising:

said switch actuator being a mechanical switch.

4. A sheet roller dispenser, comprising:

said sheet roll dispenser adapted to be mounted in a first, horizontal position or a second, vertical position;

an open-top hollow housing having a front wall;

a lid hingedly connected to said hollow housing for selectively opening and closing said open top of said hollow housing;

said lid positioned in a substantially horizontal plane when said sheet roll dispenser is in said first, horizontal position and said lid positioned in a substantially vertical plane when said sheet roll dispenser is positioned in said second, vertical position;

said hollow housing adapted to house a roll of sheet material;

a roll support member mounted in said hollow housing;

an opening formed in said front wall of said housing:

said roll support member including a generally "U"-shaped low-friction roll support member mounted in said hollow housing;

said generally "U"-shaped low friction roll support member having a bight for supporting said roll of sheet material when said housing is disposed in said first, horizontal position;

said generally "U"-shaped low friction roll support member having a substantially vertical wall for supporting said roll of sheet material when said housing is disposed in said second vertical position, said substantially vertical wall disposed in non-supporting relation to said roll of sheet material when said housing is disposed in said first, horizontal position;

a flexible and resilient arcuate bend formed in an upper end of said substantially vertical forward wall when said housing is disposed in said first, horizontal position;

a nip means mounted in registration with said opening;

said drive roller and said flexible and resilient arcuate bend collectively forming said nip means;

a free end of said sheet material adapted to be disposed in said nip means;

a motor mounted to an underside of said lid;

said motor including a power take off shaft;

a drive roller mounted to an underside of said lid;

interconnecting means for interconnecting said drive roller in driven relation to said power takeoff shaft; and a switch actuator for activating said motor;

whereby activation of said motor causes said free end of said sheet material to be unrolled, to travel through said nip means, and to be dispensed to a user through said opening.

5. The sheet roller dispenser of claim 4, further comprising:

said switch actuator being a mechanical switch.

* * * * *